US009981396B1

(12) United States Patent
Rafii

(10) Patent No.: US 9,981,396 B1
(45) Date of Patent: May 29, 2018

(54) COMBINATION UTILITY KNIFE AND BOX CUTTER AND METHOD OF USING THE SAME

(71) Applicant: Eddie Rafii, Laguna Niguel, CA (US)

(72) Inventor: Eddie Rafii, Laguna Niguel, CA (US)

( * ) Notice: Subject to any disclaimer, the term of this patent is extended or adjusted under 35 U.S.C. 154(b) by 223 days.

(21) Appl. No.: 14/734,231

(22) Filed: Jun. 9, 2015

Related U.S. Application Data

(63) Continuation-in-part of application No. 14/308,550, filed on Jun. 18, 2014, now abandoned, which is a continuation-in-part of application No. 13/764,907, filed on Apr. 16, 2013, now abandoned.

(51) Int. Cl.
*B26B 29/02* (2006.01)
*B26B 3/06* (2006.01)
*B26B 3/08* (2006.01)

(52) U.S. Cl.
CPC ..... *B26B 29/02* (2013.01); *B26B 3/06* (2013.01); *B26B 3/08* (2013.01)

(58) Field of Classification Search
CPC ..... B26B 29/02
USPC ..... 30/340, 288, 286, 2, 162, 161, 320, 151, 30/294, 329
See application file for complete search history.

(56) References Cited

U.S. PATENT DOCUMENTS

| | | | | |
|---|---|---|---|---|
| 5,386,632 | A * | 2/1995 | Schmidt | B26B 5/001 30/125 |
| 7,509,742 | B2 * | 3/2009 | Votolato | B26B 5/00 30/151 |
| 8,720,068 | B2 * | 5/2014 | Landwehr | B26B 29/02 30/162 |
| 8,732,956 | B2 * | 5/2014 | McGushion | B26B 29/02 30/151 |
| 2009/0172889 | A1 * | 7/2009 | Votolato | B25F 1/003 7/158 |

* cited by examiner

*Primary Examiner* — Sarah B McPartlin
(74) *Attorney, Agent, or Firm* — FisherBroyles, LLP; Rob L. Phillips

(57) ABSTRACT

A single operation cutting device having a safety guard which locks after each cutting action. The single operation cutting device having a housing, cutting blade holder, safety guard, safety guard release and intermediary member. The safety guard is in movable communication with said intermediary member. The intermediary member having a body translatable along a rod such that it may move responsive to said safety guard during locking and unlocking actions.

15 Claims, 16 Drawing Sheets

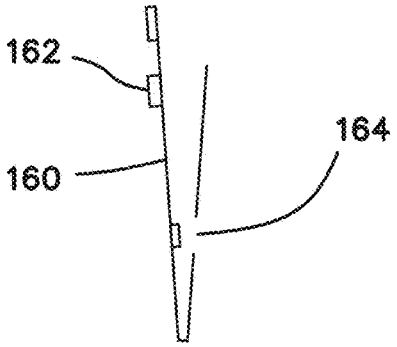
FIG. 7A
FIG. 7B
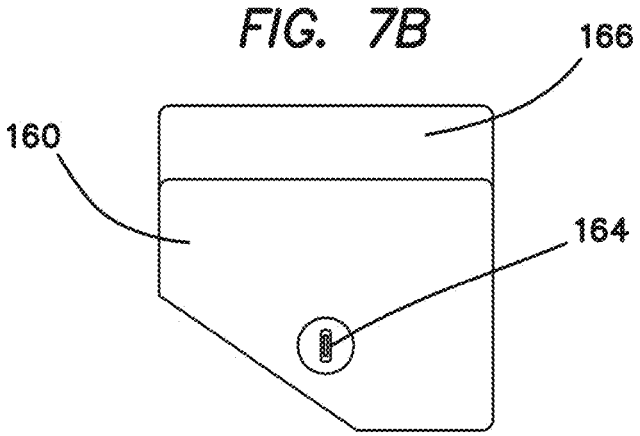
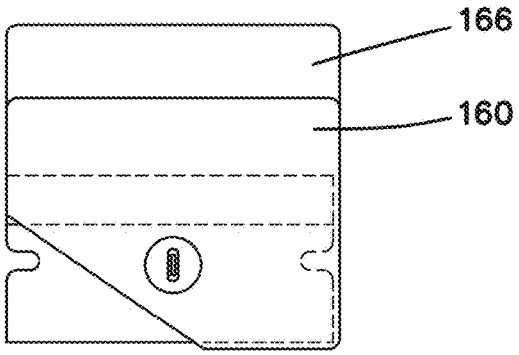
FIG. 7C
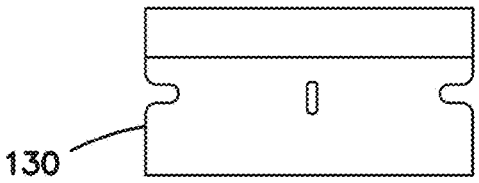
FIG. 7D

COMBINATION UTILITY KNIFE AND BOX CUTTER AND METHOD OF USING THE SAME

CROSS-REFERENCE

This application is a continuation-in-part of U.S. patent Ser. No. 14/308,550 filed Jun. 18, 2014 which is a continuation-in-part of U.S. patent application Ser. No. 13/764,907 filed Apr. 16, 2013 both of which are incorporated herein for any and all purposes.

FIELD OF THE INVENTION

The embodiments of the present invention relate to a utility knife and box cutter combined in a single housing.

BACKGROUND

Building contractors and warehouse and box store employees are just two groups of people that utilize utility knives and box cutters. One obvious drawback associated with utility knives and box cutters is the inevitable cutting of one's own hand, wrist or arm while using the same.

It would be advantageous to develop a combination utility knife and box cutter with one or more features configured to eliminate or at least reduce the likelihood of user injury. It would also be beneficial if the blade of the combination utility knife and box cutter is easily replaceable. Other benefits will become apparent from the detailed description below and associated figures.

SUMMARY

Accordingly, one embodiment of the present invention comprises a combination utility knife and box cutter broadly comprising: a housing with a channel to receive a cutting blade such that said cutting blade extends partially from said housing; a safety guard positioned proximate and in alignment with said cutting blade, said safety guard locked in position with a portion extending from said housing; and a safety guard release configured to unlock said safety guard permitting said cutting blade to be used. In one embodiment, the combination utility knife and box cutter includes a box cutter guide configured to move from a stored position to a use position and vice versa.

In use, the safety guard release may be depressed thereby unlocking the safety guard causing the safety guard, when pressed against an article to be cut, to retract into the housing leaving the cutting blade unguarded. In one embodiment, the safety guard release is a single operation device meaning that each time the user removes pressure from the safety guard, the user will need to press it again to cause the safety guard to unlock. The single operation design creates an additional layer of safety.

Another embodiment of the present invention involves a single operation (i.e., cut) device meaning that each time a cut is finished, the device must be re-activated such that the safety guard is released allowing the cutting blade to be exposed for cutting.

Other variations, embodiments and features of the present invention will become evident from the following detailed description, drawings and claims.

BRIEF DESCRIPTION OF THE DRAWINGS

FIGS. 7A-7D illustrate a blade folder configured to retain a cutting blade according to the embodiments of the present invention;

DETAILED DESCRIPTION

Figure 1:
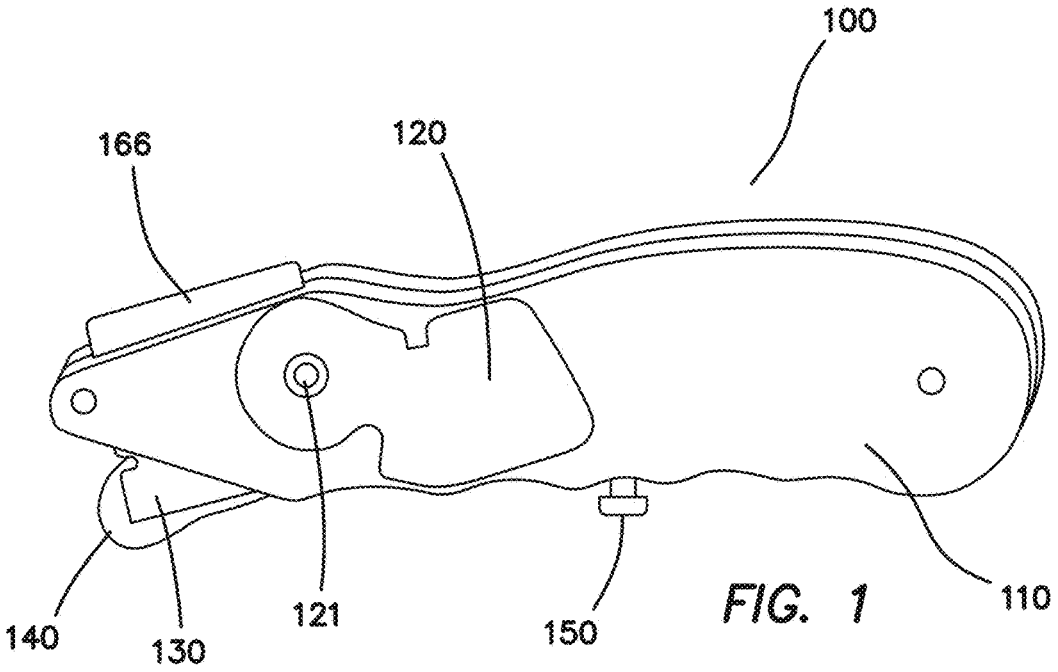
FIG. 1 illustrates a side view of a combination utility knife and box cutter with a box cutting guide in a stored position according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The individual parts of the combination utility knife and box cutter may be fabricated of metals, plastics, composites, alloys, polymers and combinations thereof. The individual parts of the combination utility knife and box cutter may be made using suitable techniques including molding, machining, rapid prototyping, casting and combinations thereof.

Figure 2:
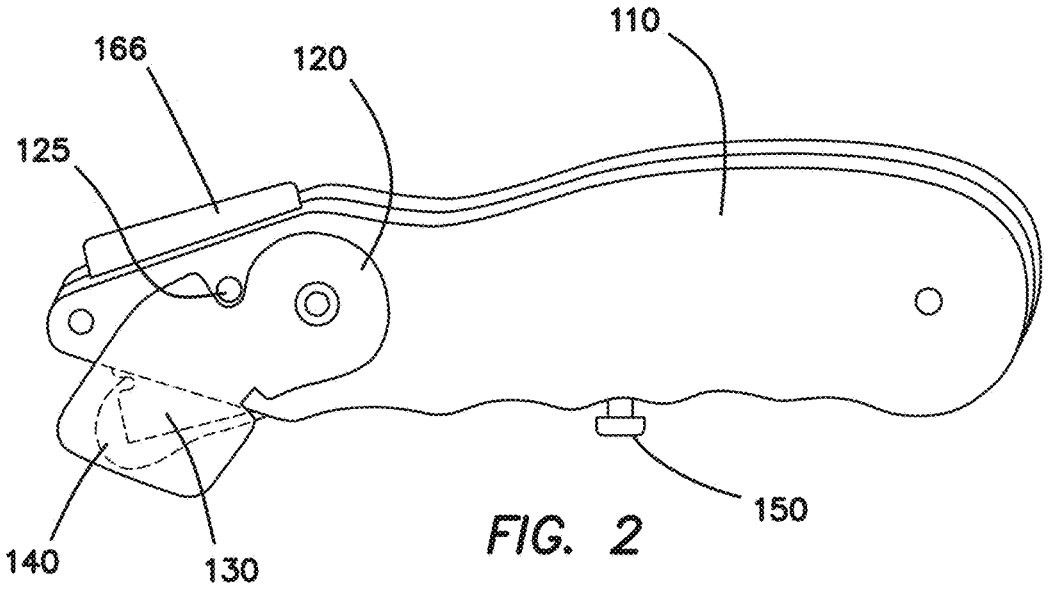
FIG. 2 illustrates a side view of a combination utility knife and box cutter with a box cutting guide in a use position according to the embodiments of the present invention.
Figure 3:
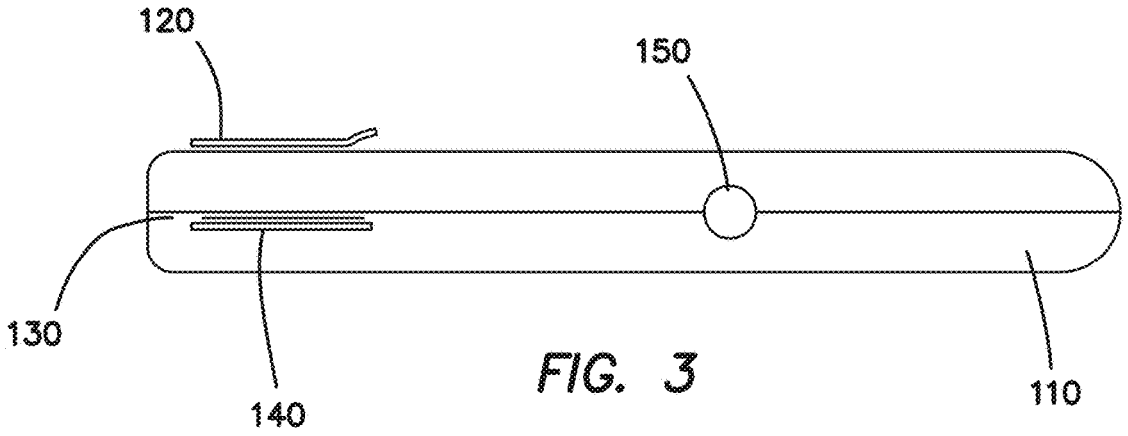
FIG. 3 illustrates a bottom view of a combination utility knife and box cutter according to the embodiments of the present invention.

FIGS. 1-3 show a combination utility knife and box cutter 100 including a housing 110, box cutter guide 120, cutting blade 130, safety guard 140, safety guard release 150 and blade folder 160. FIG. 1 shows the box cutter guide 120 in a stored position which FIG. 2 shows the box cutter guide 120 in an active position for guiding the cutting blade 130 along an outer edge of a subject box. The box cutter guide 120 rotates about a screw and spring arrangement 121. A guide stop 125 ensures a proper active position for the box cutter guide 120.

Figure 4:
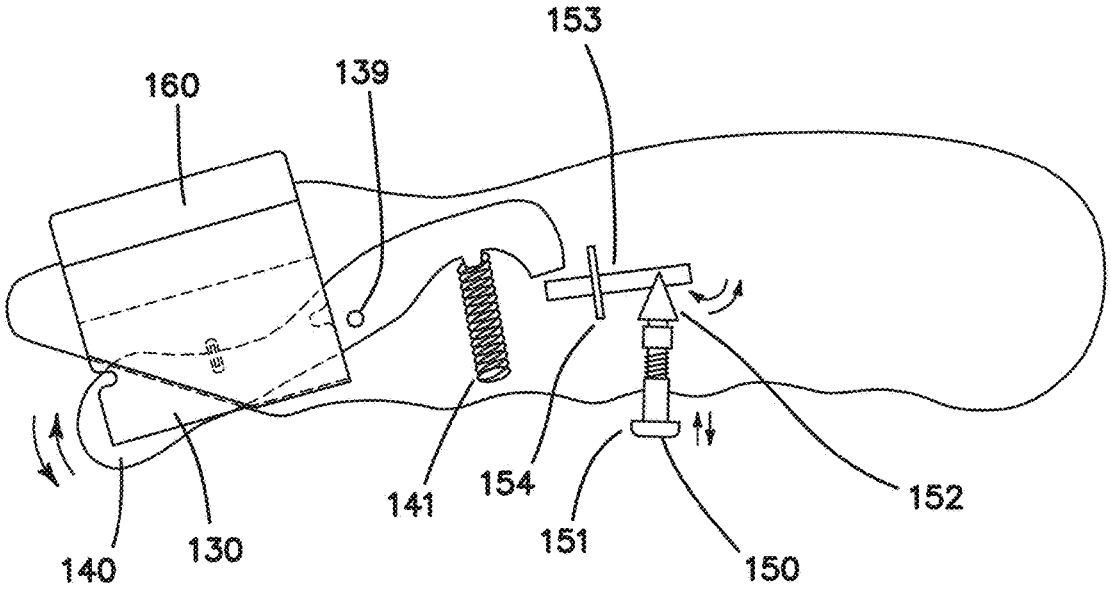
FIG. 4 illustrates a cross-section side view of a combination utility knife and box cutter according to the embodiments of the present invention.
Figure 5:
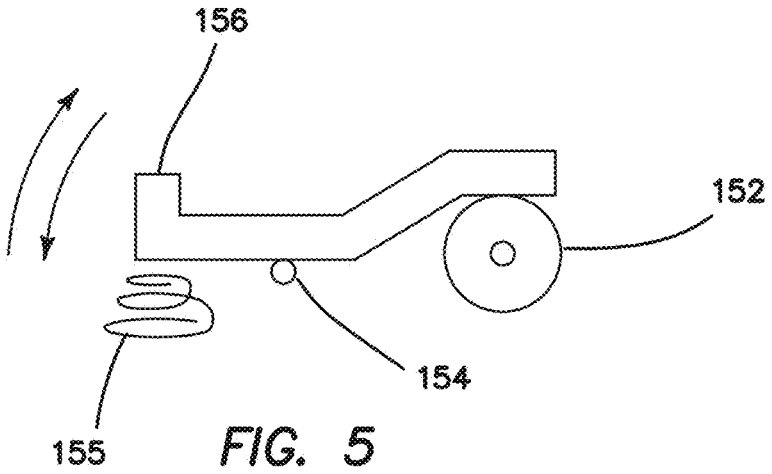
FIG. 5 illustrates a top view of safety guard release according to the embodiments of the present invention.

To prevent a user from being cut by said cutting blade 130, said safety guard 140 extends parallel to, and beyond, said cutting blade 130. In this manner, the safety guard 140 prevents a user from inadvertently contacting the cutting blade 130. The safety guard 140 is in normally a locked position as dictated by spring 141 shown in FIG. 4. The safety guard release 150 acts to unlock the safety guard 140 as detailed herein. FIG. 4 shows a cross-sectional view of the combination utility knife and box cutter 100 including the mechanics of the safety guard release 150. FIG. 5 shows an upper view of the safety guard release 150. In another embodiment, the safety guard is designed to encase the cutting blade 130 rather than extending along only one side thereof. In this embodiment, the safety guard has an opening at a bottom thereof permitting the cutting blade 130 to extend therefrom responsive to the activation of the safety guard release.

The safety guard release 150 comprises a spring-biased button 151, cone member 152, lever arm 153, pivot member 154, spring 155 and secure pin 156. In practice, the safety guard release 150 operates as follows: spring-biased button 151 is pressed causing cone member 152 to pivot push lever arm 153 about pivot member 154 thereby moving the secure pin 156 from below an internal end 142 of said safety guard 140 such that said safety guard 140 may pivot about screw and spring arrangement 121 when said external end 144 of said safety guard 140 is pressed into an article to be cut. Once pressure is removed from said spring-biased button 151 and said external end 144 of said safety guard 140, the safety guard 140 is forced back into a locked position by spring 141 which forces internal end 142 of safety guard 140 upward such that said secure pin 156 again rests below said internal end 142 preventing said safety guard 140 from moving unless said safety guard release 150 is utilized. Accordingly, the safety guard release 150 must be pressed down to allow the safety guard to retract into the housing 110. The safety guard 140 rotates, when unlocked, about a pivot 139.

In one embodiment, the tension of spring 141 is great enough that it prevents the safety guard 140 from moving with safety guard release 150 pressed unless external end 144 is pressed hard against a rigid article (e.g., cardboard, drywall, etc.). With such an embodiment, the safety guard 140 fails to move (even when safety guard release 150 is depressed) when contacting a user's skin and/or muscle, foam or other non-rigid articles. The tension of spring 141 is thus able to control the ease with which the safety guard 140 moves when unlocked.

Figure 6A:
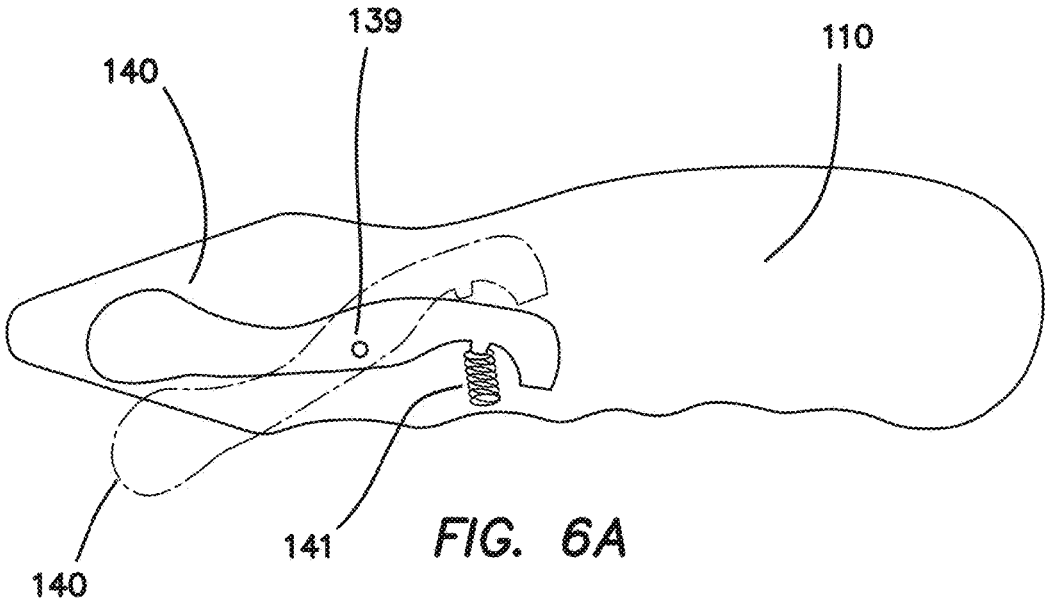
FIGS. 6A and 6B illustrate a safety guard and cutting blade in working and non-working positions according to the embodiments of the present invention.
Figure 6B:
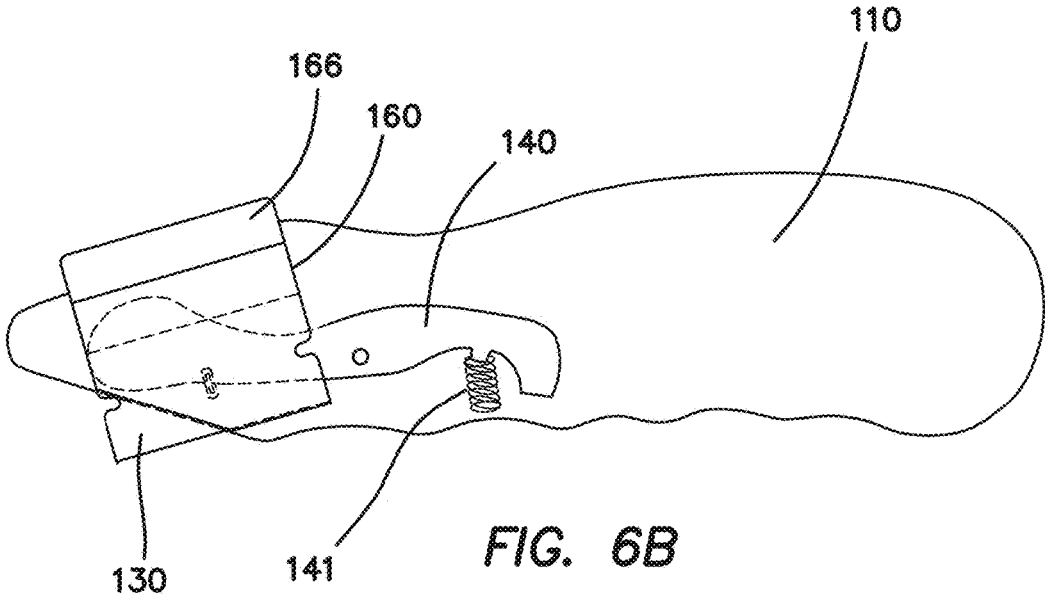

FIGS. 6A and 6B show the safety guard 140 and cutting blade 130 in working and non-working positions according to the embodiments of the present invention. Thus, when pressed against a rigid article with the safety guard 140 unlocked, the external end 144 of the safety guard 140 rotates about the screw and spring arrangement 121 and is forced by the rigid article into the housing 110 such that the cutting blade 130 is free to cut the rigid article.

FIGS. 7A-7C illustrate a blade folder 160 for maintaining the cutting blade 130 according to the embodiments of the present invention. The blade folder 160 slides into a blade folder channel 380 (shown in Fig. (B) in the housing 110. The blade folder 160 is made of a thin flexible material (e.g., aluminum). The blade folder 160 includes a pair of pins 162, 164 (best seen in FIG. 7A) positioned to hold the blade folder 160 in place within the housing 110 and the cutting blade 130 in place within the blade folder 160, respectively, as shown in FIG. 7C. An upper grip 166 facilitates easy removal of the blade folder 160 from the housing 110 as needed. An exemplary cutting blade 130 is shown in FIG. 7D.

Figure 8A:
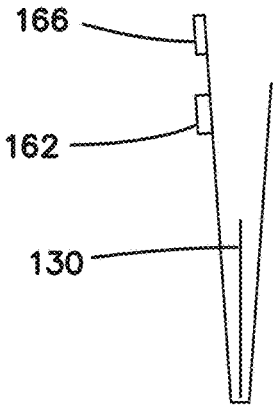
FIGS. 8A and 8B illustrate a procedure for installing and removing the cutting blade from the blade folder according to the embodiments of the present invention.
Figure 8B:
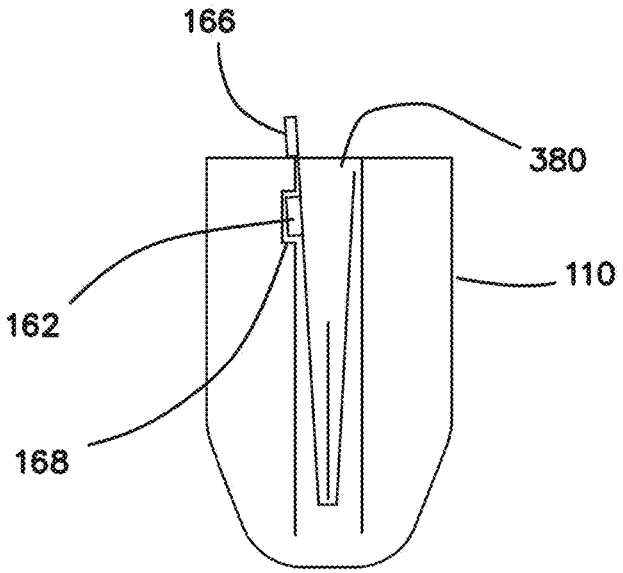

FIG. 8A shows an end view of the blade folder 160 which forms a V-shaped space for insertion of cutting blade 130 while FIG. 8B shows the blade folder 160 and cutting blade 130 in the housing 110. The flexible ("springy") material forming the blade folder 160 causes the V-shape cross-section to flex in and out for reasons detailed below. The blade folder 160 is inserted into the blade folder channel 380 in the housing 110 thereby causing a portion of the cutting blade 130 to extend from the housing 130 for purposes of cutting. A cut-out 165 in the blade folder 160 permits a portion of the cutting blade 130 to extend therefrom. Pin 162 sits in recess 168 in the housing 110 maintaining the blade folder 160 in the housing 110 during cutting operations. Removing the blade folder 160 consists of pushing the grip 166 inward to move the pin 162 out of the recess 168 such that the blade folder may be lifted from the housing 110.

Figure 9A:
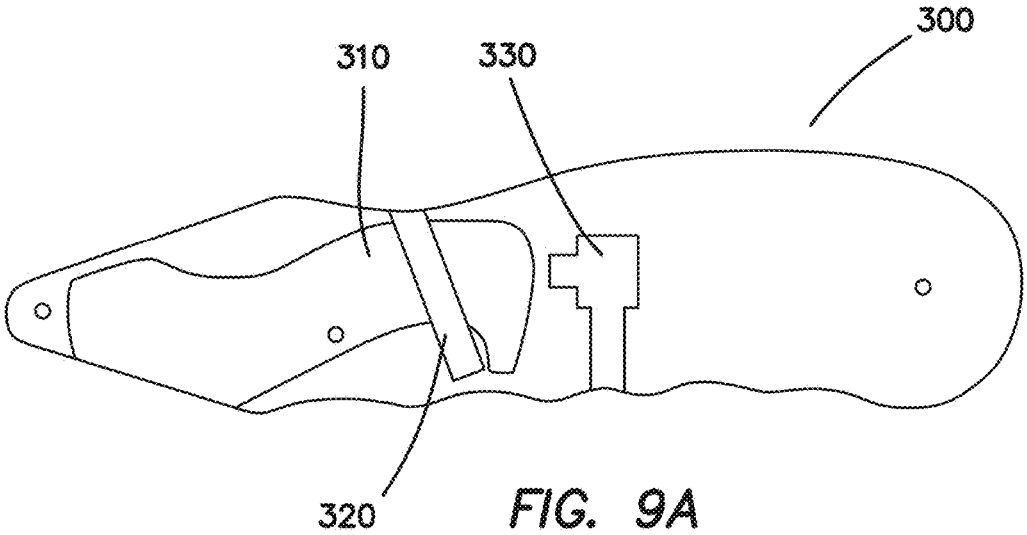
FIGS. 9A and 9B illustrate internal view of the housing according to the embodiments of the present invention.
Figure 9B:
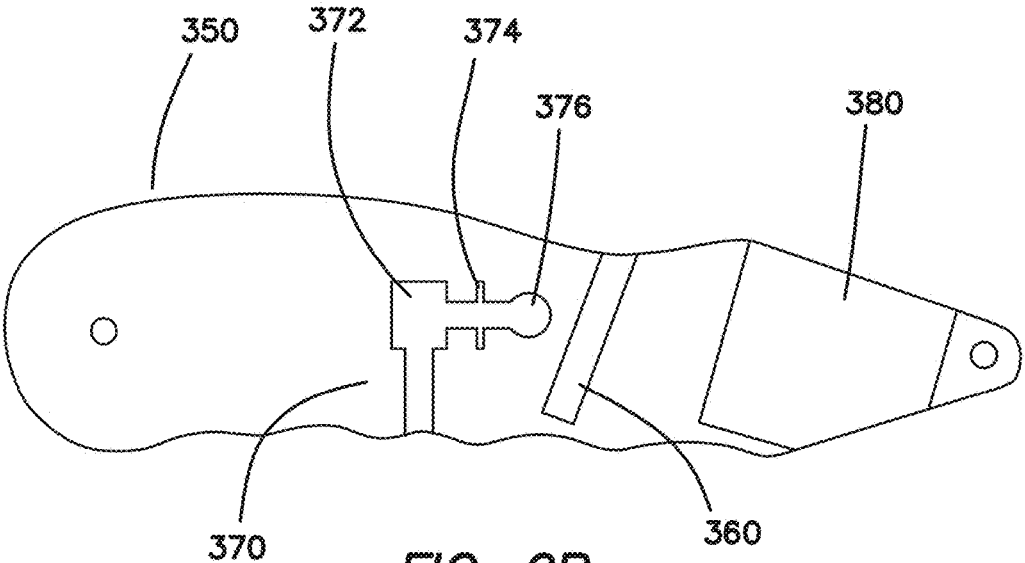

FIGS. 9A and 9B show internal views of a left side body member 300 and right side body member 350 which are connected via screws or other connectors to form the housing 110. The left side body member 300 includes a safety guard cavity 310, first half spring cavity 320 and first half safety guard release cavity 330. The right side body member 350 includes second half spring cavity 360, second half safety guard release cavity 370, including a button cavity 372, lever arm cavity 374 and spring and pin cavity 376 and blade folder channel 380. When connected, the left side body member 300 and right side body member 350 cause the first half spring cavity 320 and second half spring cavity 360, and first half safety guard release cavity 330 and second half safety guard release cavity 370 to join to form a spring cavity and safety guard release cavity.

Figure 10:
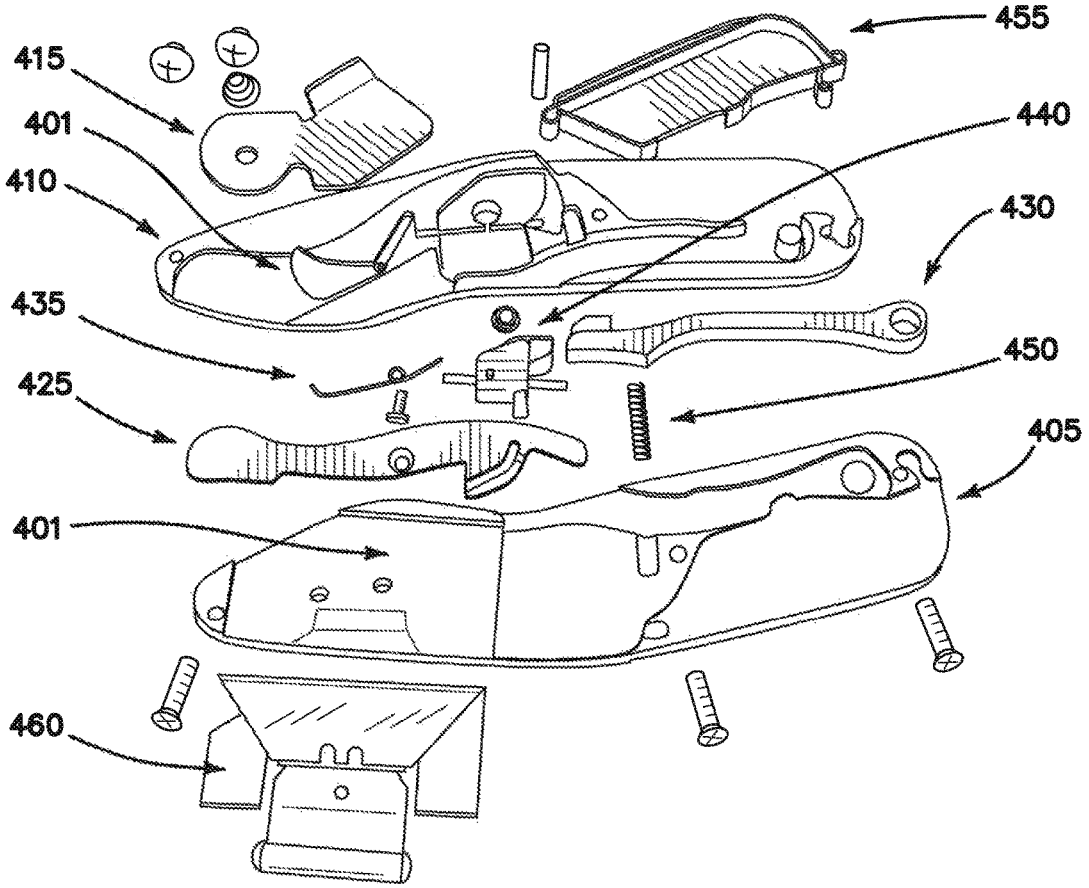
FIG. 10 illustrates components of a single cut version according to the embodiment of the present invention.

FIG. 10 shows components of a single cut device 400 according to the embodiments of the present invention. The single cut device 400 re-sets (i.e., safety guard locks) after each cut is completed providing a higher degree of safety. The components comprise left and right housing sections 405, 410, box cutter guide 415, safety guard 425, safety guard release 430, safety guard release spring 450, intermediary member 440, intermediary member support spring 445, safety guard spring 435 cutting blade compartment 455 and cutting blade holder 460. Various fasteners are also shown in FIG. 10. As shown, the left and right housing 405, 410 include cut-out portions 401 for accommodating the various internal components of the single cut device 400.

Figure 11A:
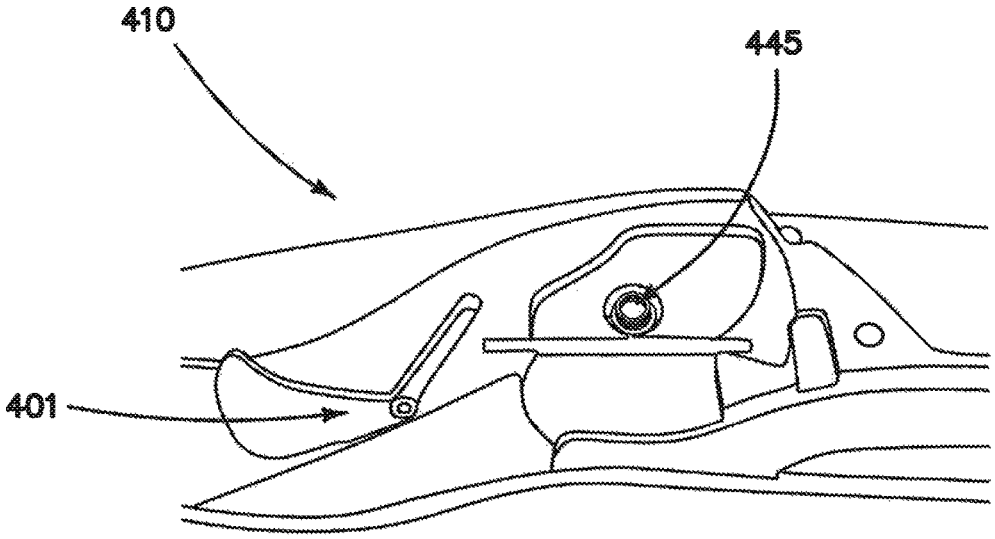
FIGS. 11A-11I illustrate various stages of fabrication of said single operation device according to the embodiments of the present invention.
Figure 11B:
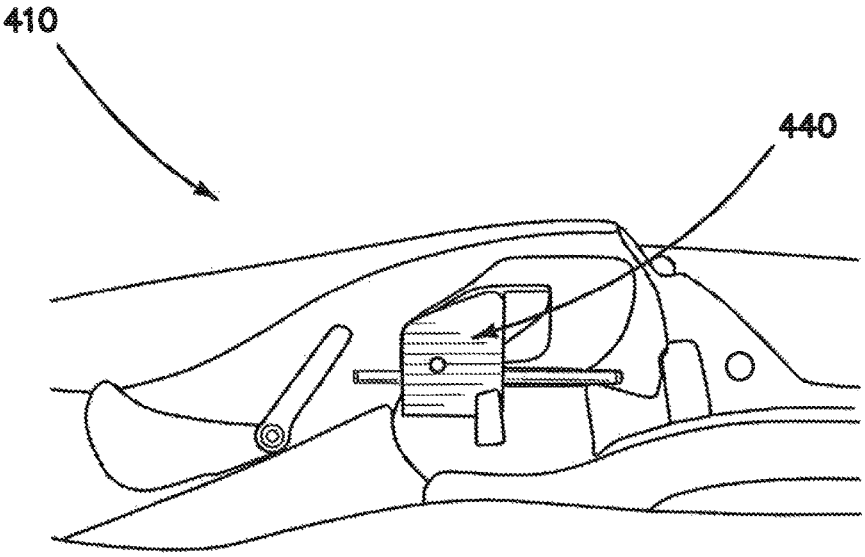
Figure 11C:
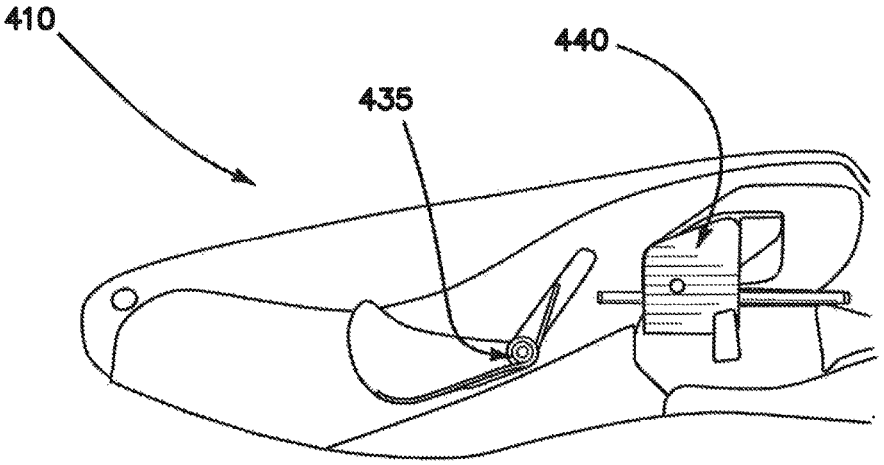
Figure 11D:
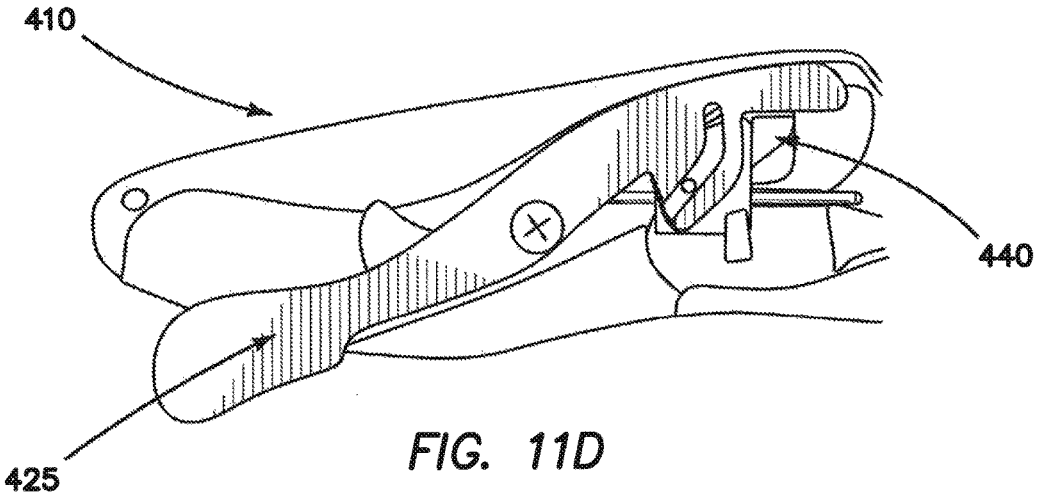
Figure 11E:
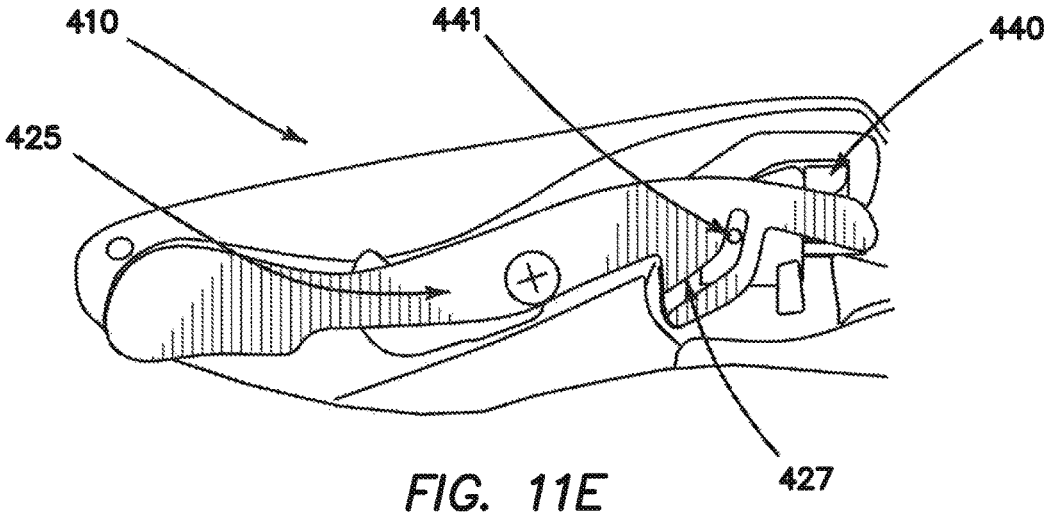
Figure 11F:
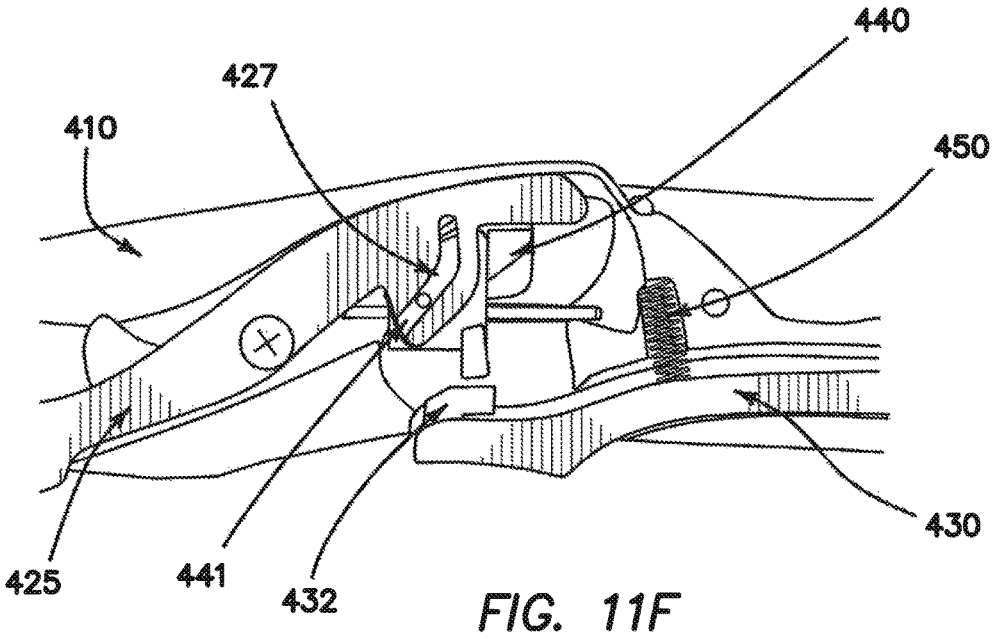
Figure 11G:
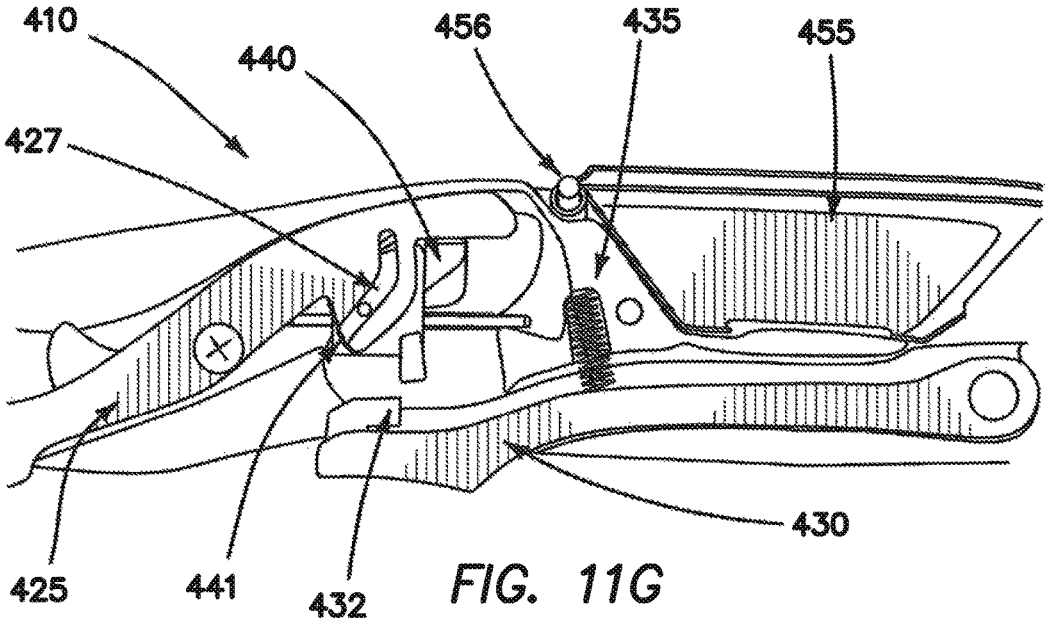
Figure 11H:
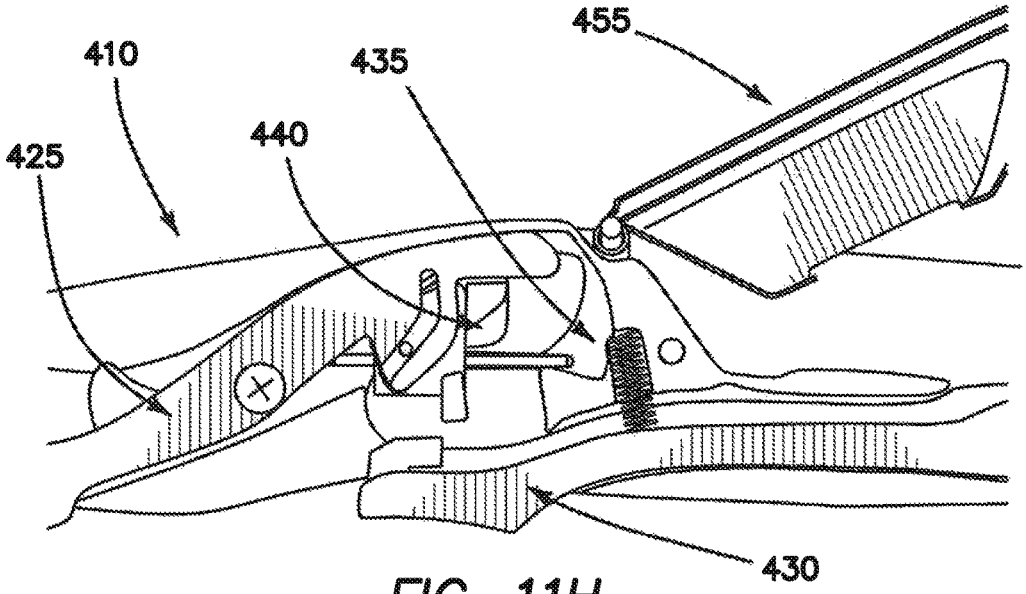
Figure 11I:
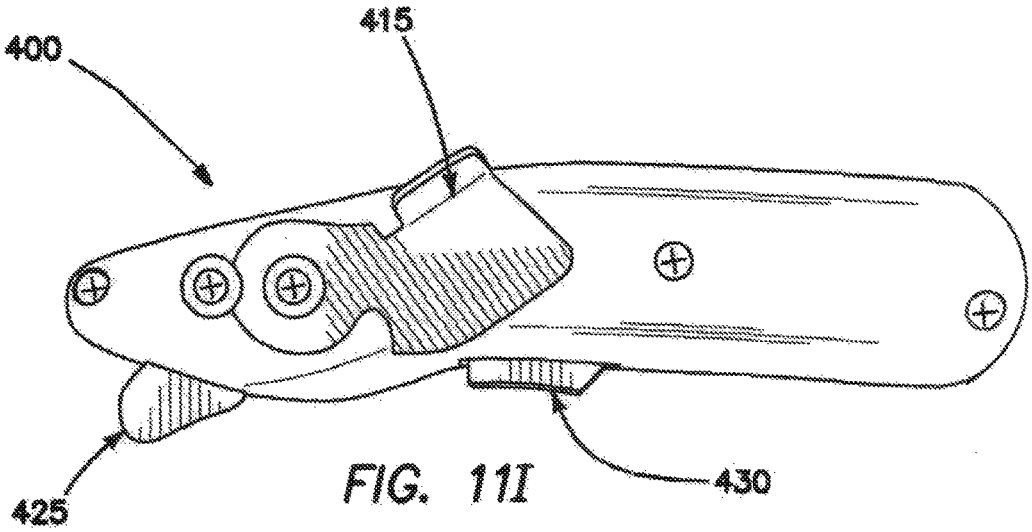
Figure 14:
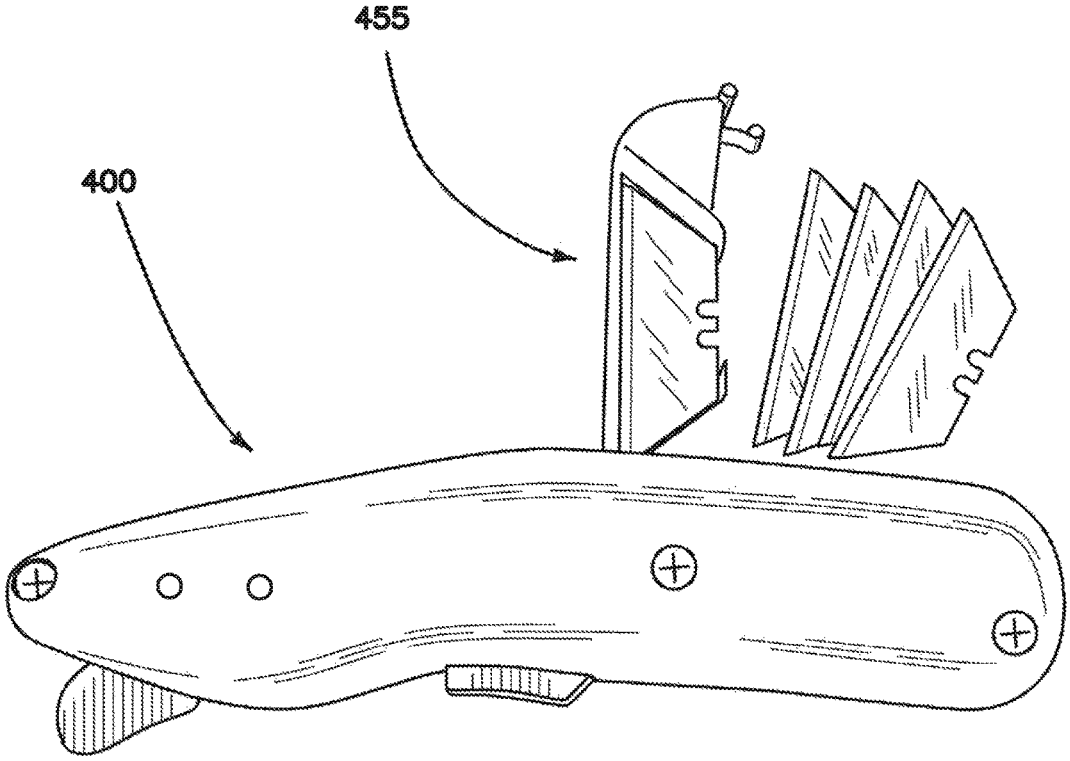
FIG. 14 illustrates the single operation device with a blade compartment in an open position according to the embodiments of the present invention.

FIG. 11A shows intermediary member support spring 445 positioned in right housing section 410. FIG. 11B shows the intermediary member 440 positioned in the right housing section 410 atop the intermediary member support spring 445. FIG. 11C shows the safety guard spring 435 positioned in the right housing section 410 proximate the intermediary member 440. FIG. 11D shows safety guard 425 connected to the right housing section 410 via a screw through the safety guard spring 435. The safety guard spring 435 acts to maintain the safety guard 425 in a down position as shown in FIG. 11D. FIG. 11E shows the safety guard 425 in an up position responsive to upward force overcoming the downward force of the safety guard spring 435. FIG. 11F shows safety guard release 430 and safety guard release spring 450 positioned in the right housing section 410. Safety guard release spring 450 maintains a down force on the safety guard release 430. A track 427 in said safety guard 425 receives pin 441 in said intermediary member 440. FIG. 11G shows the cutting blade compartment 455 attached and FIG. 11H shows the cutting blade compartment 455 rotated into an open position as it rotates about pin 456 (FIG. 14 shows the completed single cut device 400 with the cutting blade compartment 455 in an open position). FIG. 11I shows the fabricated single cut device 400 with the right and left housing sections 405, 410 joined to one another and safety guard 425 attached.

Figure 12A:
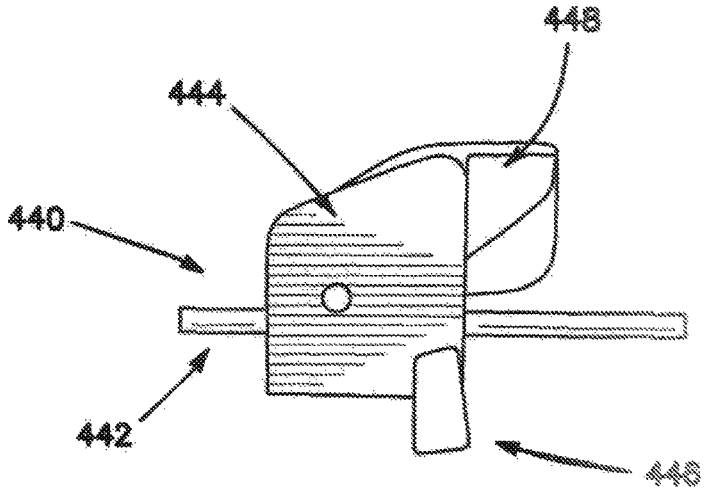
FIGS. 12A-12D illustrate various views of an intermediary member according to the embodiments of the present invention.
Figure 12B:
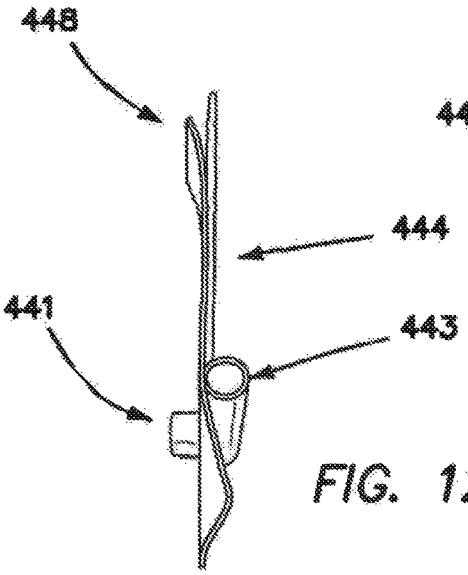
Figure 12C:
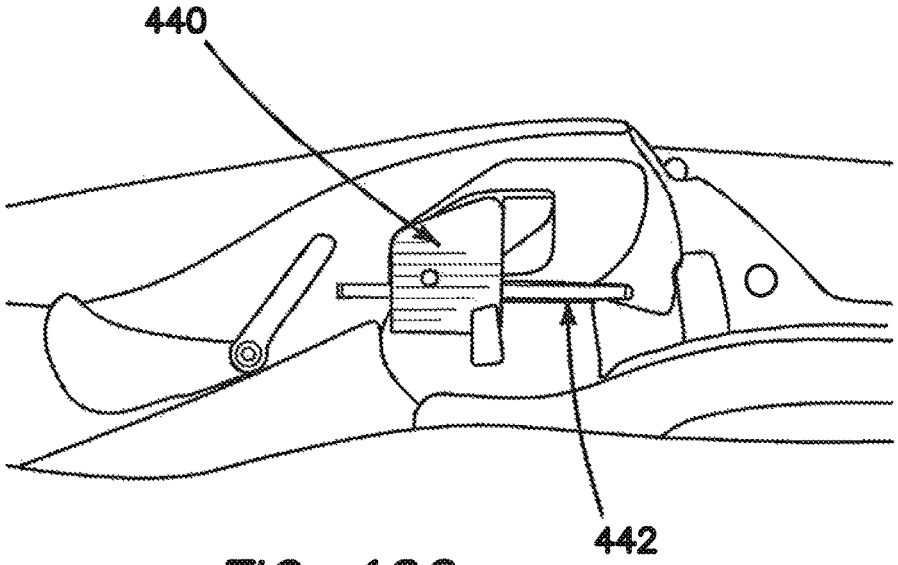
Figure 12D:
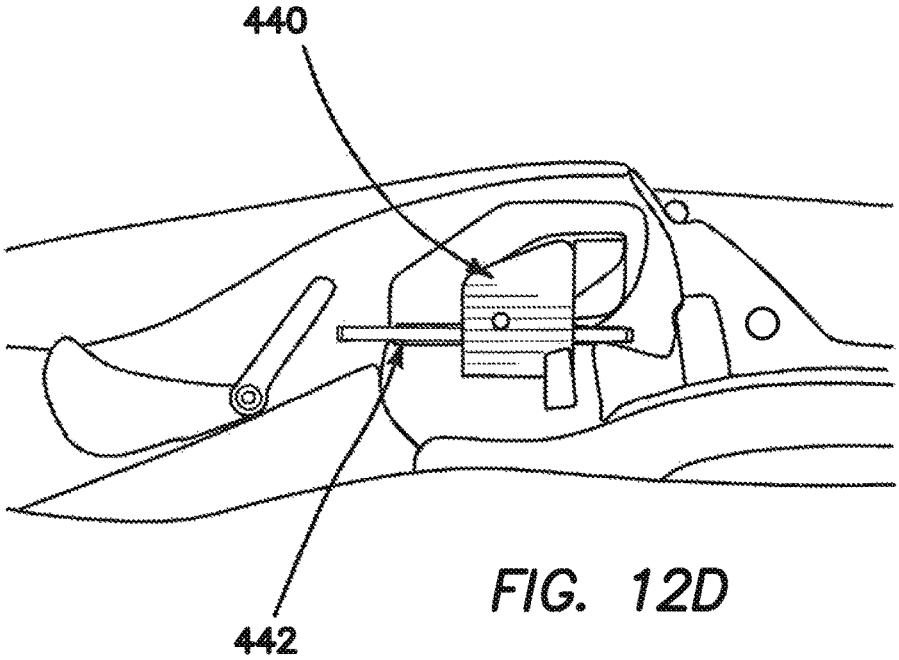

As best seen in FIGS. 12A-12D, the intermediary member 440 comprises a rod 442, body 444, extension member 446 and stop 448. The rod 442 inserts through a cylindrical channel 443 in the intermediary member 440 such that the body 444 is able to slide along said rod 442 for reasons detailed below. FIG. 12C shows the body 444 in a forward position and FIG. 12D shows the body 444 in a rearward position. In practice, the movement of the safety guard 425 causes the movement of the body 444.

Figure 13A:
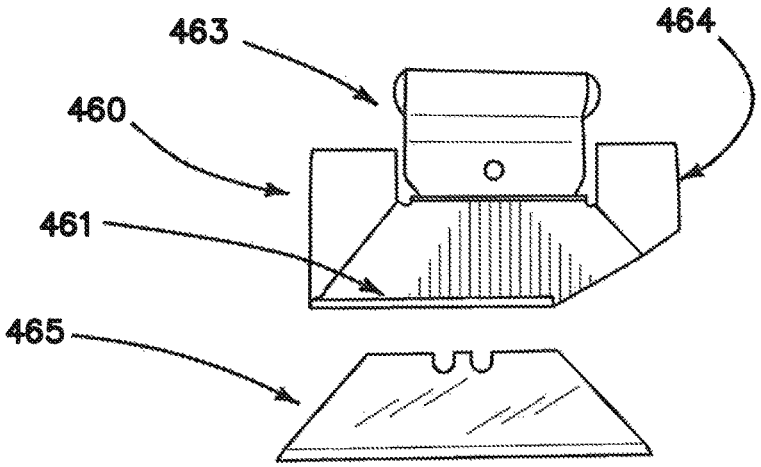
FIGS. 13A-13E illustrate a cutting blade holder and blade of the single operation device according to the embodiments of the present invention.
Figure 13B:
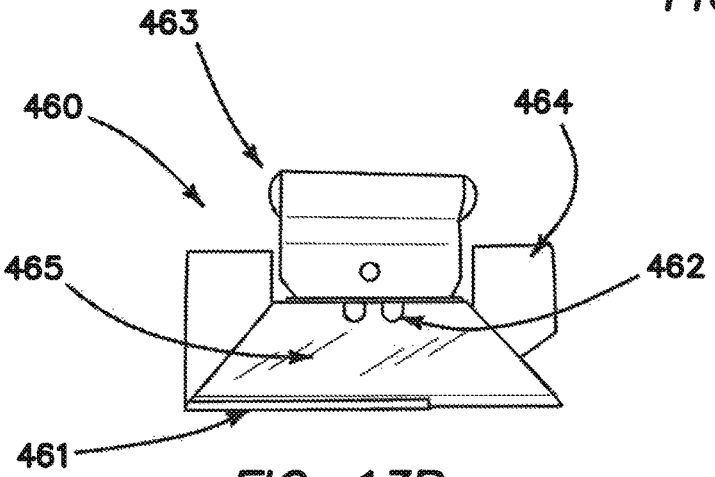
Figure 13C:
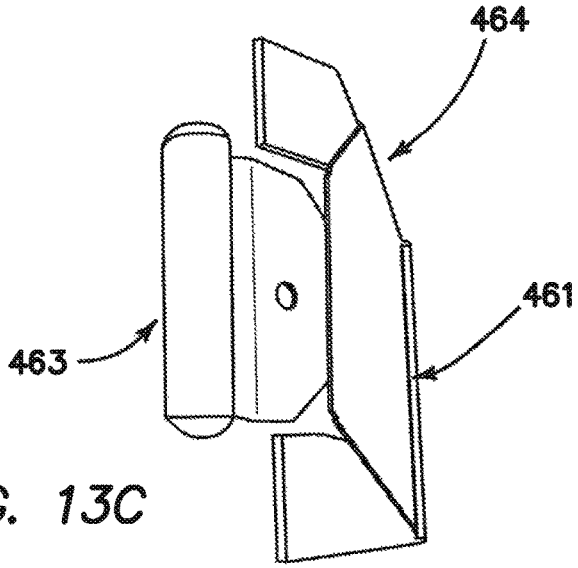
Figure 13D:
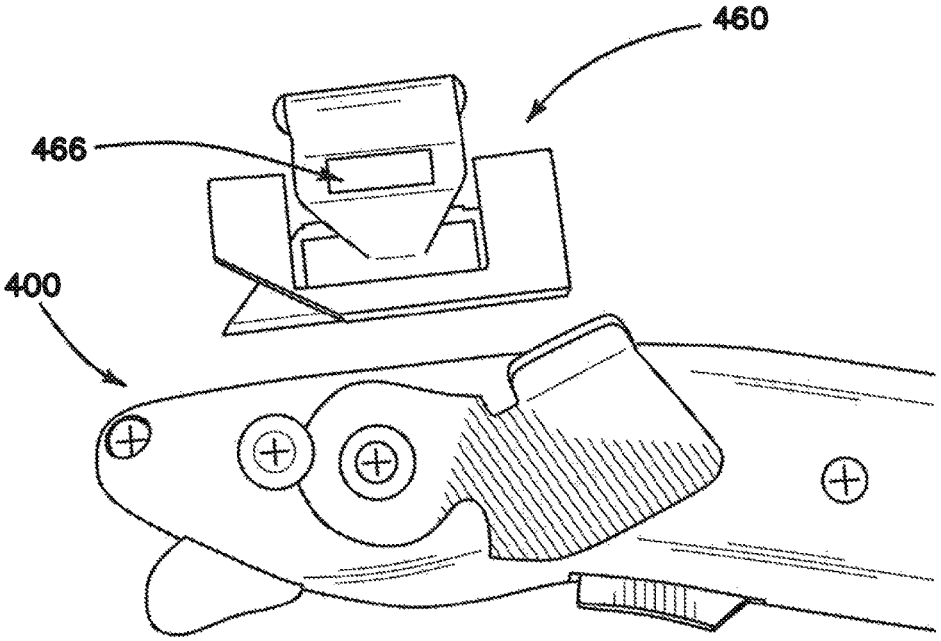
Figure 13E:
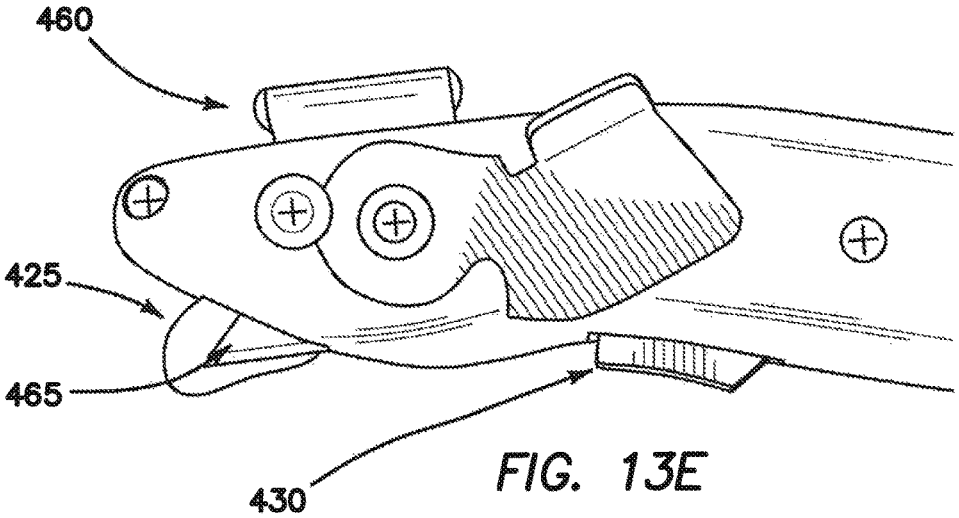

FIGS. 13A-13E show the cutting blade holder 460 and blade 465. The cutting blade holder 460 includes a ridge 461 which accommodates the sharp edge of the blade 465 and a pair of clips 462 help to retain the blade 465 in the cutting blade holder 460. A spring-like handle member 463 permits a user to install and remove the cutting blade holder 460 for changing the blade 465. The spring-like handle member 463 may be moved, in a pinching manner, relative to the blade holder section 464. FIG. 13D shows a bulge 466 which serves to maintain the cutting blade holder 460 in the single cut device 400. FIG. 13E shows the single cut device 400 receiving the cutting blade holder 460 and blade 465. The cutting blade holder 460 slides into a cavity in the single cut device 400. Removal of the cutting blade holder 460 involves moving the spring-like handle member 463 which moves the bulge 466 allowing the cutting blade holder 460 to be slid out of the cavity.

Operation of the single cut device 400 is as follows: (i) user depresses the safety guard release 430 which causes the intermediary member 440 to pivot slightly about intermediary member support spring 445 as a safety guard release blade 432, which is flexible, contacts and raises said extension member 446 causing said oppositely positioned stop 448 to lower allowing the safety guard 425 to rotate past said lowered stop 448 of said intermediary member support spring 445; (ii) as the user then places the safety guard 425 against an article to be cut, the safety guard 425 rotates about the connection point of the safety guard spring 435 to the right housing section 405 moving said body 444 rearward along said rod 442 the user is then able to make a cut with the portion of blade 465 extending from said single cut device 400; and (iii) once the cut is complete and pressure in no longer applied to said safety guard 425, safety guard spring 435 urges the safety guard 425 into its external home position and as this occurs the body 444 moves forward along said rod 442 to its home position whereby said stop 448 is positioned to once again prevent the safety guard 425 from moving without a subsequent depression of the safety guard release 430. As the body 444 moves rearward, the extension member 446 clears the safety guard release blade 432 allowing the intermediary member 440 to move back to its home position. Curved track 427 in the safety guard 425 facilitates the corresponding movement of the safety guard 425 and body 444.

FIG. 14 shows the single cutting device 400 with the cutting blade compartment 455 in an open position. The cutting blade compartment 455 acts as a storage area for blades.

Although the invention has been described in detail with reference to several embodiments, additional variations and modifications exist within the scope and spirit of the invention as described and defined in the following claims.

I claim:

1. A single operation cutting device comprising:

a housing accommodating a cutting blade holder and cutting blade whereby said cutting blade extends partially from said housing;

a safety guard positioned such that a portion thereof extends proximate to, and in alignment with, said cutting blade;

a safety guard release configured to unlock said safety guard, via an intermediary member, permitting said cutting blade to be exposed for use; and said intermediary member in communication with said safety guard and configured to lock said safety guard in position after a cut is complete and no pressure is being applied to said safety guard, said intermediary member slidable along a rod into a rearward position responsive to pressure being applied to said safety guard during a cutting action and slidable into a forward locking position along said rod responsive to no pressure being applied.

2. The single operation cutting device of claim 1 wherein said intermediary member comprises an extension member and stop.

3. The single operation device of claim 2 wherein said safety guard release includes a flexible blade positioned to raise said extension member thereby lowering said stop such that said safety guard may be moved responsive to upward force associated with a cutting action.

4. The single operation cutting device of claim 1 further comprising a blade storage compartment having an open and closed position.

5. The single operation cutting device of claim 1 wherein said cutting blade holder includes a spring-biased handle member and blade holding section, said spring-biased handle member movable relative to said blade holding section.

6. A single operation cutting device comprising:

a housing accommodating a cutting blade holder and cutting blade whereby said cutting blade extends partially from said housing;

a safety guard positioned such that a portion thereof extends proximate to, and in alignment with, said cutting blade;

a safety guard release configured to interact with an intermediary member to unlock said safety guard permitting said cutting blade to be exposed for use, said safety guard having a track in moveable communication with a pin extending from said intermediary member; and said intermediary member in communication with said safety guard and configured to lock said safety guard in position after a cut is complete and no pressure is being applied to said safety guard, said intermediary member slidable along a rod into a rearward position responsive to pressure being applied to said safety guard during cutting action and slidable into a forward locking position along said rod responsive to no pressure being applied.

7. The single operation cutting device of claim 6 wherein said intermediary member comprises an extension member and stop.

8. The single operation cutting device of claim 7 wherein said safety guard release includes a flexible blade positioned to raise said extension member thereby lowering said stop such that said safety guard may be moved responsive to upward force associated with a cutting action.

9. The single operation cutting device of claim 7 further comprising a blade storage compartment having an open and closed position.

10. The single operation cutting device of claim 6 wherein said cutting blade holder includes a spring-biased handle member and blade holding section, said spring-biased handle member movable relative to said blade holding section.

11. A single operation cutting device comprising:

a housing accommodating a cutting blade holder and cutting blade whereby said cutting blade extends partially from said housing;

a safety guard positioned such that a portion thereof extends proximate to, and in alignment with, said cutting blade;

a safety guard release configured to unlock said safety guard, via an intermediary member, permitting said cutting blade to be exposed for use; and wherein said safety guard is movably joined to said intermediary member, said intermediary member including a body movable along a rod for locking and unlocking said safety guard responsive to removal of pressure on said safety guard and depression of said safety guard release, respectively, said intermediary member slidable along a rod into a rearward position responsive to pressure being applied to said safety guard during cutting action and slidable into a forward locking position along said rod responsive to no pressure being applied.

12. The single operation cutting device of claim 11 wherein said intermediary member comprises an extension member and stop.

13. The single operation cutting device of claim 12 wherein said safety guard release includes a flexible blade positioned to raise said extension member thereby lowering said stop such that said safety guard may be moved responsive to upward force associated with a cutting action.

14. The single operation cutting device of claim 11 further comprising a blade storage compartment having an open and closed position.

15. The single operation cutting device of claim 11 wherein said cutting blade holder includes a spring-biased handle member and blade holding section, said spring-biased handle member movable relative to said blade holding section.

* * * * *